US010981751B2

(12) United States Patent
Gainche et al.

(10) Patent No.: US 10,981,751 B2
(45) Date of Patent: Apr. 20, 2021

(54) GUIDE RAIL FOR A LIFT SYSTEM

(71) Applicant: thyssenkrupp Elevator Innovation and Operations GmbH, Essen (DE)

(72) Inventors: Philippe Gainche, Großbettlinen (DE); Thomas Kuczera, Leinfelden-Echterdingen (DE)

(73) Assignee: TK Elevator Innovation and Operations GmbH, Essen (DE)

( * ) Notice: Subject to any disclaimer, the term of this patent is extended or adjusted under 35 U.S.C. 154(b) by 356 days.

(21) Appl. No.: 15/758,816

(22) PCT Filed: Aug. 31, 2016

(86) PCT No.: PCT/EP2016/070435
§ 371 (c)(1),
(2) Date: Mar. 9, 2018

(87) PCT Pub. No.: WO2017/042057
PCT Pub. Date: Mar. 16, 2017

(65) Prior Publication Data

US 2020/0231408 A1 Jul. 23, 2020

(30) Foreign Application Priority Data

Sep. 10, 2015 (DE) ..... 10 2015 217 262.7

(51) Int. Cl.
*B66B 7/02* (2006.01)

(52) U.S. Cl.
CPC ..... *B66B 7/024* (2013.01); *B66B 7/022* (2013.01)

(58) Field of Classification Search
CPC ..... B66B 7/022; B66B 7/024; B66B 7/02; B66B 7/026; B66B 7/023
See application file for complete search history.

(56) References Cited

U.S. PATENT DOCUMENTS 3,128,875 A * 4/1964 Key et al. ..... B65G 25/10 198/743
3,420,337 A * 1/1969 Magee ..... B66B 7/047 187/408

(Continued)

FOREIGN PATENT DOCUMENTS

CN 85103415 A 10/1986
CN 1087598 A 6/1994

(Continued)

OTHER PUBLICATIONS

CN103241627—Machine Translation (Year: 2013).*
English Translation of International Search Report issued in PCT/EP2016/070435, dated Oct. 25, 2016 (dated Nov. 2, 2016).

*Primary Examiner* — Michael A Riegelman
(74) *Attorney, Agent, or Firm* — William J. Cassin

(57) ABSTRACT

A guide rail for an elevator system may include at least one rail element that is fastened by at least one fastening means to at least one shaft wall of the elevator system. The at least one rail element may be mounted in a movable manner in relation to at least one shaft wall. The at least one rail element can be moved in relation to the at least one shaft wall such that a space behind the at least one rail element and the shaft wall is accessible for inspection purposes. In some cases, the fastening means includes a hinge by which the rail element can swivel relative to the shaft wall.

20 Claims, 8 Drawing Sheets

(56) References Cited

U.S. PATENT DOCUMENTS

| | | | | |
|---|---|---|---|---|
| 5,469,938 | A * | 11/1995 | Biewald | B66B 7/022 187/408 |
| 6,371,249 | B1 * | 4/2002 | Schops | B66B 7/024 187/408 |
| 2011/0226561 | A1 * | 9/2011 | Santos | B66B 7/024 187/408 |
| 2012/0133164 | A1 * | 5/2012 | Sanz Gamboa | B66B 7/024 294/119.1 |
| 2019/0177125 | A1 * | 6/2019 | Gainche | B66B 7/024 |
| 2019/0367327 | A1 * | 12/2019 | Kallio | B66B 7/026 |
| 2020/0062547 | A1 * | 2/2020 | Simonatto Marques | B66B 7/024 |
| 2020/0062548 | A1 * | 2/2020 | Gainche | B66B 7/02 |
| 2020/0115190 | A1 * | 4/2020 | Xiong | B66B 7/024 |

FOREIGN PATENT DOCUMENTS

| | | | |
|---|---|---|---|
| CN | 1772588 | A | 5/2006 |
| CN | 101315248 | A | 12/2008 |
| CN | 201647759 | U | 11/2010 |
| CN | 103183278 | A | 7/2013 |
| CN | 103241627 | A | 8/2013 |
| CN | 203255847 | U | 10/2013 |
| CN | 203545403 | U | 4/2014 |
| EP | 0585777 | A | 3/1994 |
| EP | 2562120 | A | 10/2016 |
| GB | 1231921 | A | 5/1971 |
| JP | S61130572 | U | 8/1986 |
| JP | 0213590 | A | 1/1990 |
| JP | H0648672 | A | 2/1994 |
| JP | 2011195252 | A | 10/2011 |
| JP | 5496319 | B | 5/2014 |

* cited by examiner

GUIDE RAIL FOR A LIFT SYSTEM

CROSS REFERENCE TO RELATED APPLICATIONS

This application is a U.S. National Stage Entry of International Patent Application Serial Number PCT/EP2016/070435, filed Aug. 31, 2016, which claims priority to German Patent Application No. DE 10 2015 217 262.7, filed Sep. 10, 2015, the entire contents of both of which are incorporated herein by reference.

FIELD

The present disclosure generally relates to lift systems, including guide rails used in elevator systems for guiding elevator cars in a shaft.

BACKGROUND

Guide rails are used in elevator systems for guiding elevator cars along an elevator shaft.

In the case of long shaft lengths, guide rails are typically assembled from individual rail elements during installation.

In the case of elevator systems with linear motors, a large portion of the electrical and electronic equipment of an elevator system is housed in the space between elevator rail and shaft wall.

This compact design, however, has the drawback that the guide rail has to be dismounted from the shaft wall during maintenance work, repairs, or the need to replace the electrical and electronic equipment. Due to the modular design of a guide rail assembled from individual rail elements, in such a case it is often necessary to dismount only individual rail elements and not the entire guide rail. However, the rail elements have to be readjusted during every removal and reinstallation. This causes a substantial labor expense.

It is therefore desirable to be able to perform maintenance and repair work on the elevator electrical and electronic equipment without having to completely dismount the guide rail or individual rail elements of the guide rail and reinstall them again on the shaft wall.

From JP 1106-48672 A rail elements are known which can be rotated about their mounting, by which they are secured to a shaft wall, in order to thus switch between a vertical direction and a horizontal direction in the elevator shaft and to thereby change the direction of travel of an elevator car from the vertical to the horizontal direction and vice versa at the upper and lower end of the elevator shaft.

DETAILED DESCRIPTION

Figure 1:
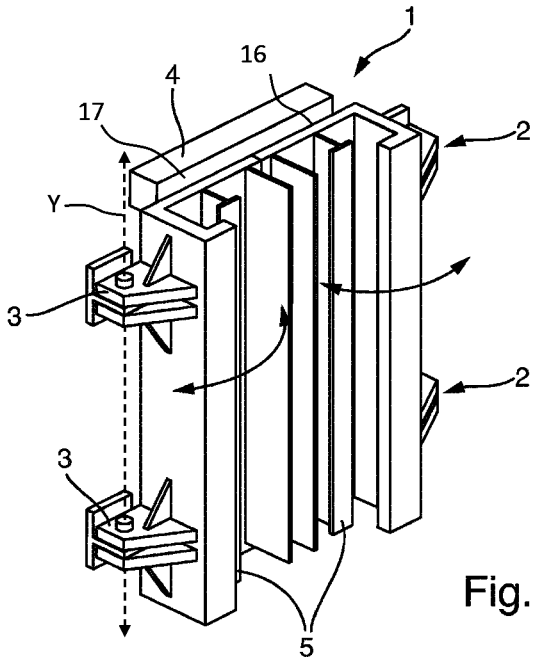
FIG. 1 is a perspective view of an example rail element divided in a vertical direction into two segments, both segments being mounted in a movable manner with hinges.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

In some examples of the present disclosure, a guide rail or individual rail elements are secured by fastening means to a shaft wall or several shaft walls. The fastening means may be configured such that the guide rail or the individual rail elements are mounted in a movable manner relative to the shaft wall or the shaft walls.

Furthermore, the guide rail for some example elevator systems 15 may comprise at least one rail element that is fastened by at least one fastening means to at least one shaft wall. The rail element can be mounted in a movable manner relative to the shaft wall and the rail element can be moved relative to the shaft wall such that a space between a rear side of the rail element and the shaft wall may be accessible for inspection purposes.

Unlike the prior art, the present disclosure make accessible the entire space between the at least one rail element of the guide rail and the shaft wall by moving the at least one rail element in relation to the at least one shaft wall, without having to completely dismount the guide rail or individual rail elements of the guide rail and reinstall them again on the shaft wall.

By using suitable fastening means, the at least one rail element can be mounted so that it can swivel, rotate, shift or travel on at least one fastening means in relation to the at least one shaft wall.

Thus, the at least one fastening means of the at least one rail element can have, for example, rails and the at least one rail element can be outfitted with rollers, by which the at least one rail element is mounted on the rails of the at least one fastening means in a displaceable manner in relation to the at least one shaft wall. On the latter, the at least one rail element can be shifted in relation to the shaft wall, toward which the rear side of the at least one rail element is facing.

A mounting of the rail element on rails, on which the at least one rail element can be shifted by means of rollers, has the advantage that the wear on the at least one fastening means is very slight during the movement of the at least one rail element in order to gain access to the electrical and electronic equipment situated behind it. In place of rollers, the at least one rail element can also however be outfitted with ball cups, in which balls are mounted. When using rollers, the at least one rail element can be moved in at most two spatial dimensions. Thanks to the use of balls, a further degree of freedom is produced, so that the at least one rail element can be moved in the elevator shaft in as many as three spatial dimensions. In this way, the at least one rail element can also travel, for example, on curved or angled rails in relation to the at least one shaft wall.

A further option is a configuration of the at least one fastening means having at least one hinge, by which the at least one rail element is mounted in a swivelable manner in relation to the at least one shaft wall. The at least one rail element can thus be provided on one side or many sides with a plurality of hinges.

In addition, the at least one fastening means of the at least one rail element has at least one interlock with which the at least one hinge can be connected to the at least one shaft wall and/or the at least one rail element or released from the at least one rail element and/or the at least one shaft wall.

In this way, the at least one rail element can have hinges on several sides, so that by inserting or removing the at least one interlock the at least one rail element can be individually swiveled in a desired direction by means of one or more hinges on one of the sides of the at least one rail element in relation to the at least one shaft wall.

The at least one hinge can thus form a structural unit with the at least one interlock.

The at least one interlock can be formed as a pin, for example, which joins together a hinge element at the rail-element side and a hinge element at the shaft-wall side. In this case, the at least one interlock fashioned as a pin also constitutes the axis of rotation about which the at least one rail element can be swiveled. By removing or inserting the pin, a hinge can be individually placed into or removed from operation. Thus, all the pins can be removed from the hinges which are not required for the desired swivel direction, leaving installed only the pins serving as the axis of rotation for the desired swivel direction.

After maintenance is completed, the at least one rail element can simply be swiveled back and anchored, by putting back the pins removed, in its designated position as part of the guide rail, with no extensive adjustment work, so that the at least one rail element does not veer out unintentionally from the guide rail structure.

However, the at least one interlock can also be arranged between a hinge element and the at least one rail element or a hinge element and the at least one shaft wall. The at least one interlock can also take the form of screws, with which the at least one hinge element is secured to the at least one shaft wall and/or at least one other rail element. The screws can be installed or removed according to whether or not the at least one rail element should be allowed to swivel with a particular hinge.

Another option would be to secure the hinges for example with magnets to the at least one rail element and/or the at least one shaft wall, so that the hinges not needed for the desired swivel direction can be removed from operation temporarily by loosening the magnets.

The mounting of the at least one rail element by at least one fastening means, having at least one hinge, which is secured in a fixed position to at least one shaft wall, has the advantage that the at least one rail element can easily be swung away from the at least one shaft wall for maintenance work and swung back into its designated position once more upon conclusion of the maintenance work, without having to readjust the at least one rail element in relation to its position in the elevator shaft.

In another embodiment option, the at least one rail element can be swiveled in relation to the at least one shaft wall by at least one fastening means, having at least one swivelable swivel arm provided with joints. In this case, a swivel arm can have as many hinge-like joints and/or ball joints as desired.

The use of swivel arms as part of the fastening means has the advantage that the at least one rail element can be moved by on them into any desired positions in the elevator shaft, only limited by the length and the mobility of the swivel arms, and the at least one rail element can be swiveled back into its designated position with no strenuous adjustment work.

The at least one fastening means on which the at least one rail element is mounted in a movable manner can also have at least one telescopically extendable structure.

By means of such a telescopic structure, the at least one rail element can either be moved orthogonally from the at least one shaft wall, to which the rear side of the at least one rail element is facing, into the elevator shaft, or be shifted in parallel with this shaft wall.

With such a structure, the at least one rail element can be shifted continuously in a plane so as to free up the space situated behind it. In the same way, the at least one rail element can be shifted back into its designated position in the elevator shaft once more.

However, the at least one rail element can also be secured by at least one fastening means to at least one shaft wall in such a way that the at least one rail element can be rotated about at least one axis. One variant constitutes a single anchoring point, arranged on the at least one rail element in a central area, about which the at least one rail element can be rotated. When using a ball joint at the anchoring point, the at least one rail element can not only be rotated parallel in relation to the at least one shaft wall, toward which the rear side of the at least one rail element is facing, but also still be tilted in relation to the at least one shaft wall.

In order to free up the entire space situated behind the at least one rail element, it is advantageous to configure the at least one fastening means of the at least one rail element such that the at least one rail element can not only undergo a rotating movement by the at least one fastening means, but can also shift, travel, or swivel.

For example, the at least one fastening means of the at least one rail element can have at least one telescopic structure, by which the at least one rail element can be shifted, the at least one telescopic structure having an anchoring point at its ends facing the at least one rail element, about which the at least one rail element can be rotated.

By combinations of different fastening means, the at least one rail element can be moved in any desired spatial directions in relation to the at least one shaft wall. Thus, for example, combinations are conceivable which allow the at least one rail element to be shifted in parallel with the at least one shaft wall, toward which the rear side of the at least one rail element is facing, and in addition it can be swiveled or rotated in relation to this by means of hinges.

In order to afford further options for an access to the space between the at least one rail element and the at least one shaft wall, toward which the rear side of the at least one rail element is facing, the at least one rail element can be divided at least once into segments in the vertical direction, while at least one segment of the at least one rail element divided in the vertical direction is mounted in a movable manner in relation to the at least one shaft wall. This means that each segment of the at least one rail element divided once in the vertical direction has at least one fastening means, by which the at least one segment is mounted in a movable manner in relation to the at least one shaft wall, or, however, the only one subset of the segments of the at least one rail element divided in the vertical direction is mounted in a movable manner, while other segments of the same rail element are in rigid connection with the at least one shaft wall.

In order to replace the at least one rail element, which was moved out from its guide rail position for maintenance or repair work purposes, back into its exact designated position, the at least one shaft wall, toward which the rear side of the at least one rail element is facing, can have at least one anchoring point 20. The at least one movably mounted rail element can be anchored in a fixed position by means of at least one interlock at the at least one anchoring point 20. The at least one interlock can be, for example, a hook, a screw, a pin, or a magnetic holder. The anchoring of the at least one movably mounted rail element can prevent the latter from unintentionally moving out from its guide rail position. Likewise, the at least one rail element can be anchored to at least one further rail element in the vertical direction. In this case, the at least one rail element is connected to the shaft bottom and/or the shaft ceiling and/or to at least one other rail element by anchoring points 20.

In addition, the shaft wall, toward which the rear side of the at least one movably mounted rail element is facing, can have markings which facilitate the exact positioning of the at least one rail element.

The sample embodiment represented in FIG. 1 shows a rail element 1, which is secured in a movable manner by fastening means 2, having hinges 3, on the shaft wall 4, toward which the rear side 16 of the rail element 1 is facing. Each time, two fastening means 2 are arranged here at the right and left of the rail element 1. The number of hinges 3 can vary as need be.

In the example shown, the rail element 1 is divided at the middle in the vertical direction Z into two segments 5. As a result, each of the two segments 5 is fastened at one end by two fastening means 2 outfitted with hinges 3 to the shaft wall 4. Thus, the segments 5 of the rail element 1 form a kind of hinged door and can each be swiveled away about a separate axis Y (only one such axis is shown for the left such segment of the divided rail element 5 shown in the drawing figure) separately from the shaft wall 4 to gain access to the space 17 behind the rear side 16 of the rail element, defined between the shaft wall and the rear side of the rail element 1.

Figure 2:
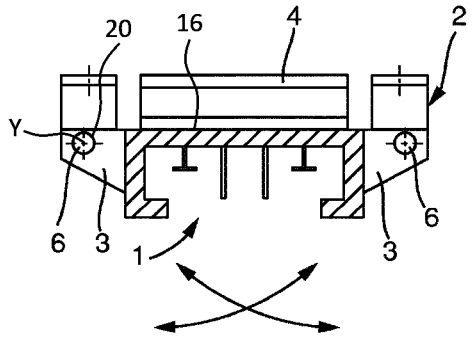
FIG. 2 is a top view of an example rail element whose fastening means have hinges, and which can be swiveled as needed about one of two axes of rotation.

FIG. 2 shows a top view of a rail element 1. On its right and left-side the rail element 1 has fastening means 2, having hinges 3 for their part. The rail element 1 is movably fastened by the fastening means 2 to the shaft wall 4, toward which the rear side 16 of the rail element is facing. The hinges 3 form a structural unit with interlocks 6, which are fashioned as pins in the sample embodiment shown. The interlocks 6 join together a shaft wall-side hinge element and a rail element-side hinge element. By removing an interlock 6, one hinge 3 can be removed from operation. In this way, by removing the interlocks 6 fashioned as pins from the hinges 3 of the right-side fastening means 2 of the rail element 1, the rail element 1 can be swiveled out from the shaft wall 4 about axis Y by means of the hinges 3 of the left-side fastening means 2 of the rail element 1. In this case, the interlocks 6 fashioned as pins of the hinges 3 of the left-side fastening means 2 of the rail element 1 form the axis of rotation about which the rail element 1 can be swiveled. Vice versa, the interlocks 6 fashioned as pins of the hinges 3 of the left-side fastening means 2 of the rail element 1 can also be removed and the rail element 1 swiveled away from the shaft wall 4 by means of the hinges 3 of the right-side fastening means 2, in which case the interlocks 6 fashioned as pins of the hinges 3 of the right-side fastening means 2 of the rail element 1 form the axis of rotation about which the rail element 1 can be swiveled. By reinserting the interlocks 6 into the hinges 3, the rail element can again be firmly connected in its designated position to the shaft wall 4, so that an unintentional swiveling-out of the rail element 1 is prevented.

Figure 3:
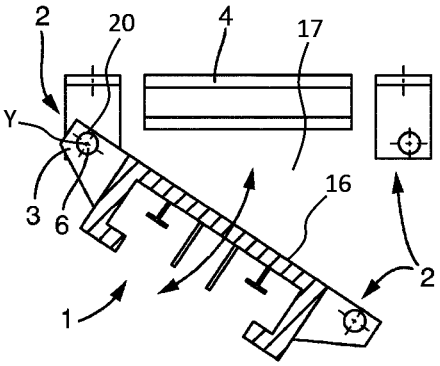
FIG. 3 is a top view of the rail element shown in FIG. 2 in a state swiveled out from the shaft wall.

FIG. 3 shows the rail element 1 depicted in FIG. 2 in a state swiveled away from the shaft wall 4 about axis Y. In this case, the interlocks 6 at anchoring points 20 have been removed from the hinges 3 of the right-side fastening means 2 of the rail element 1 and the rail element 1 has been swiveled about axis Y by means of its left-side fastening means 2, having hinges 3 including interlocks 6 at anchoring points 20. The interlocks 6 of the hinges 3 of the left-side fastening means 2 of the rail element 1 form the axis Y of rotation about which the rail element 1 is swiveled.

Figure 4:
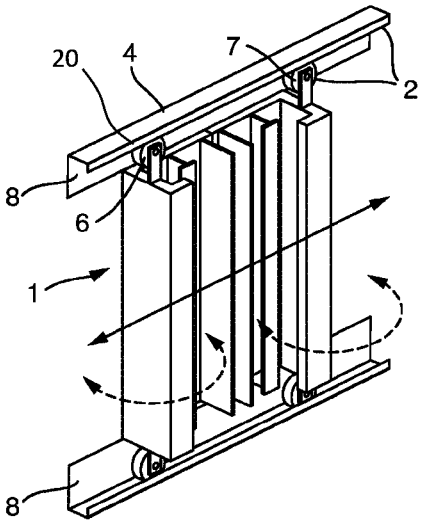
FIG. 4 is a perspective view of an example rail element outfitted with rollers and able to be shifted sideways along rails.

FIG. 4 shows a rail element 1 whose fastening means 2 have rollers 7 and rails 8, by which fastening means 2 the rail element 1 is secured movably to a shaft wall 4. The rollers 7 are arranged by means of interlocks 6 at the upper and lower end of the rail element and are guided in the rails 8, which are mounted on the shaft wall 4. The rail element 1 can be shifted sideways parallel to the shaft wall 4.

The interlocks 6, by which the rollers 7 are secured on the rail element 1, can be individually removed or put back. By removing the interlocks 6 connecting the right-(left-)side rollers 7 to the rail element 1, the rail element 1 can be swiveled when using suitable interlocks 6, such as, for example, pins. The interlocks 6 of the left-(right-)side rollers 7 of the rail element 1 here form the axis of rotation about which the rail element 1 can be swiveled.

Figure 5:
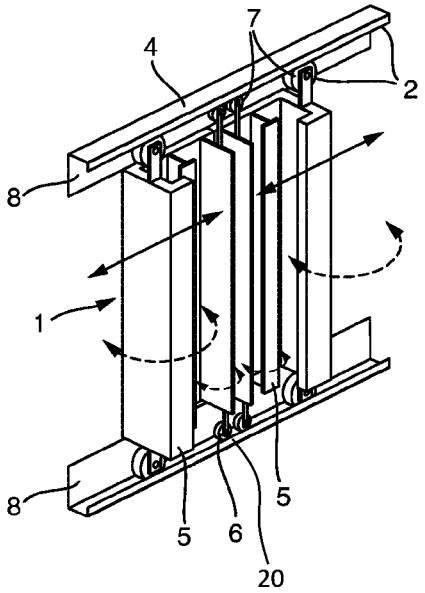
FIG. 5 is a perspective view of an example rail element divided in a vertical direction into two segments, both segments being outfitted with rollers and both segments being able to be shifted sideways along rails.

FIG. 5 shows a modification of the sample embodiment of FIG. 4, in which the rail element 1 is divided in the vertical direction into segments 5. The segments 5 are outfitted here with rollers 7 and the segments 5 can be shifted sideways separately from each other along rails 8 which are mounted on a shaft wall 4. The rollers 7 are arranged by means of interlocks 6 at the upper and lower end of the rail element. Exactly as in the sample embodiment of FIG. 4, in this sample embodiment as well the interlocks 6, by which the rollers 7 are secured to the segments 5, can be individually removed or put back, making it possible for the individual segments 5 not only to be shifted along the rails 8, but also to be swiveled from a segment 5 by removing the interlocks 6 on one side. By removing the interlocks 6 which connect the right-(left-)side rollers 7 of a segment 5 to the segment 5, the interlocks 6 of the left-(right-)side rollers 7 of the segment 5 form the axis of rotation about which the segment 5 can be swiveled.

Figure 6:
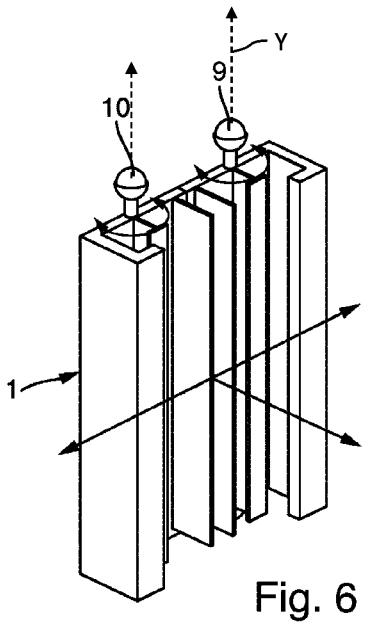
FIG. 6 is a perspective view of an example rail element outfitted with balls encased in ball cups.
Figure 7:
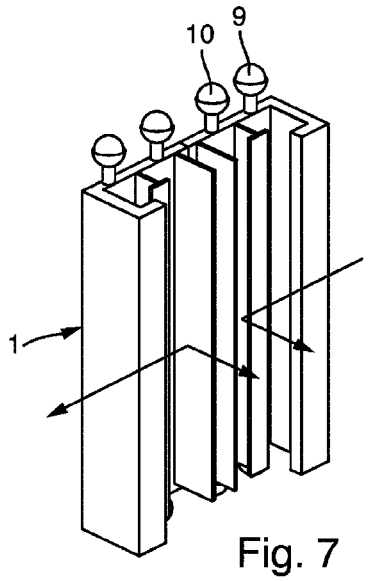
FIG. 7 is a perspective view of an example rail element divided in a vertical direction into two segments, both segments being outfitted with balls encased in ball cups.

The sample embodiments represented in FIGS. 6 and 7 are a variation of the sample embodiments from FIGS. 4 and 5, wherein the fastening means 2 have balls 9 instead of rollers 7, which are encased in ball cups 10. With the aid of the balls 9, a rail element 1 (FIG. 6) or a segment 5 of a rail element (FIG. 7) can not only be shifted sideways along rails, as in the sample embodiments of FIGS. 4 and 5, but also travel for example on curved trajectories, or swiveled about an axis Y.

Figure 8:
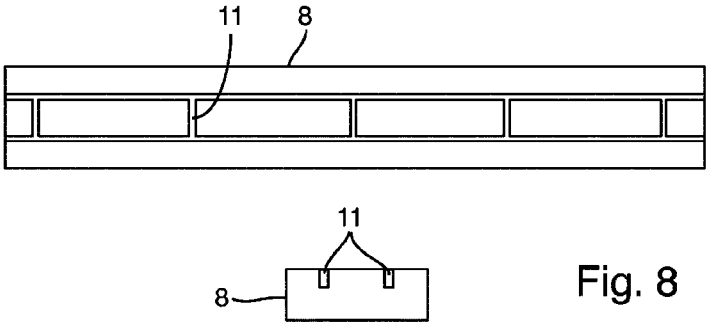
FIG. 8 is a schematic representation of an example rail on which a rail element or segments of a rail element as per FIG. 6 and FIG. 7 can travel.

FIG. 8 shows one possible embodiment (top view and side view) of a rail 8 such as can be used for the guiding of the sample embodiments represented in FIGS. 6 and 7. The rail 8 has joints, in which the balls 9 of the fastening means 2 are guided. In the variant shown, the rail 8 has two joints parallel to each other and extending in the longitudinal direction of the rail 8, which are joined together by additional joints (connection joints). In this way, a rail element 1 or a segment 5 of a rail element 1 can not only be shifted sideways along one of the joints in the longitudinal direction of the rail 8, but also move back and forth by means of the connection joints between them. The connection joints here can either be straight, as shown in FIG. 8, or curved.

Figure 9:
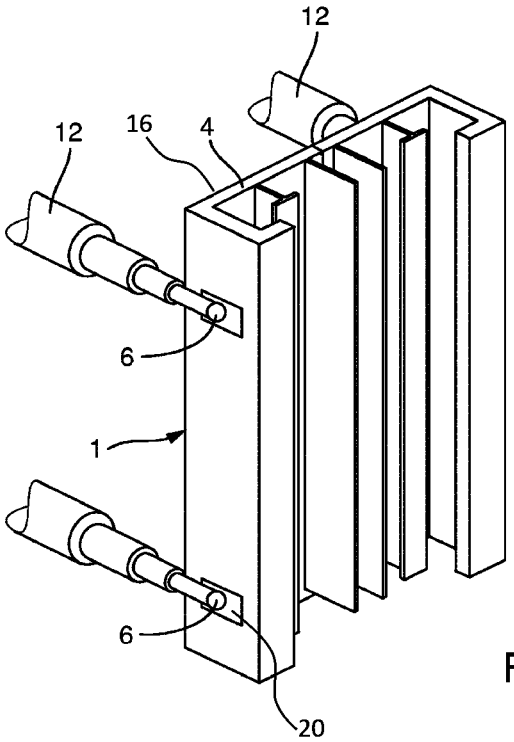
FIG. 9 is a perspective view of an example rail element having telescopic structures with which the rail element can be moved in an orthogonal direction away from its rear-side shaft wall.
Figure 10:
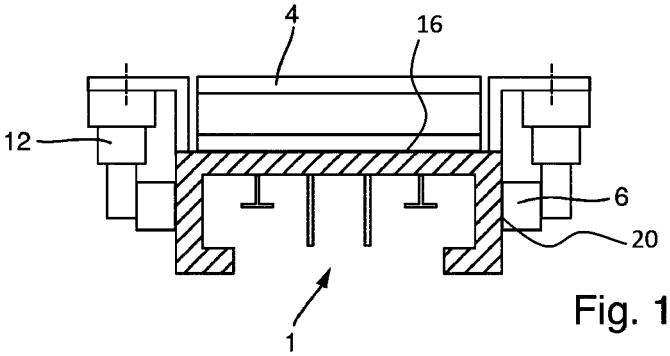
FIG. 10 is a top sectional view of the example rail element shown in FIG. 9.

FIGS. 9 and 10 (top view of the sample embodiment of FIG. 9) show a rail element 1 whose fastening means 2 have a telescopic structure 12. With the fastening means 2, the rail element 1 is mounted in a movable manner on the shaft wall 4, toward which the rail element 1 is facing by its rear side 16. Thus, the rail element 1 can be shifted by extending of the telescopic structures 12 in the orthogonal direction away from the shaft wall 4 and into the interior of the shaft.

The telescopic structures 12 are secured each time on the rail element 1 and on the shaft wall 4 by detachable interlocks 6 at anchoring points 20. The embodiment shown in FIGS. 9 and 10 can be combined with the embodiment from FIGS. 2 and 3. It is possible for the telescopic structures 12 to have hinges 3 (not shown in FIGS. 9 and 10) at their shaft wall-side ends and/or at their rail element-side ends. By removing the interlocks 6 on one of the sides of the rail element 1, the rail element 1 can not only be shifted by means of the telescopic structures 12, but also in addition it can still be swiveled by means of hinges 3.

Accordingly, it would likewise be conceivable for the rail element 1 shown in FIGS. 9 and 10 to be divided in the vertical direction Z into segments 5. In this case, in analogous fashion, a combination with the sample embodiment of FIG. 1 is possible.

Figure 11:
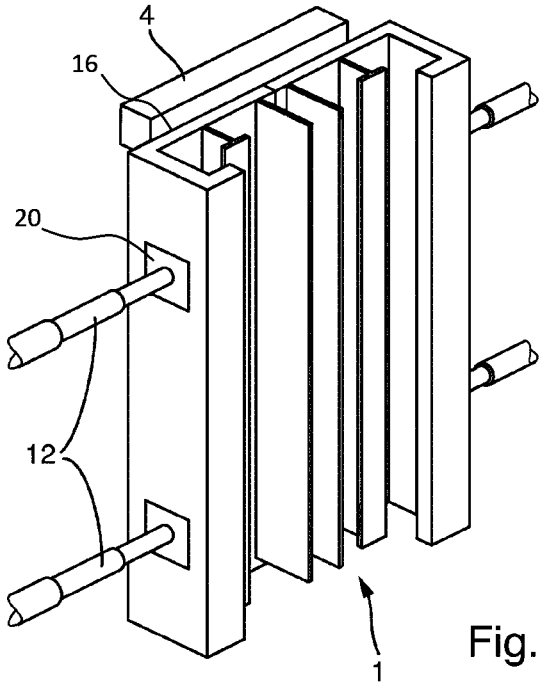
FIG. 11 is a perspective view of an example rail element having telescopic structures with which the rail element can be moved in a direction parallel to its rear-side shaft wall.
Figure 12:
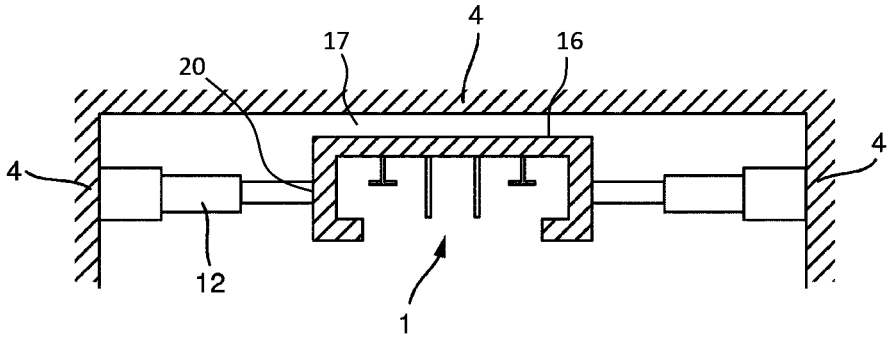
FIG. 12 is a top sectional view of the example rail element shown in FIG. 11.

FIGS. 11 and 12 (top view of the sample embodiment of FIG. 11) show a slight variation of the sample embodiment of FIGS. 9 and 10. Here as well, the fastening means 2 have telescopic structures 12 connected to the rail element 1 at anchoring points 20. However, in this case the rail element 1 is not secured to the shaft wall 4 toward which the rear side 16 of the rail element 1 is facing, but instead to the two shaft walls 4 toward which the right and left-side wall of the rail element 1 is facing. The rail element 1 can be shifted parallel in relation to the shaft wall 4 toward which the rear side 16 of the rail element 1 is facing. When the rail element 1 is shifted, the telescopic structures 12 arranged at the left (right)side of the rail element 1 are extended, while the telescopic structures 12 arranged at the right (left) side of the rail element 1 are contracted.

The sample embodiment shown in FIGS. 11 and 12 can also be used for a rail element 1 divided in the vertical direction Z into two segments 5. The two segments 5 can be pushed out separately from each other from their guide rail position. The segments 5 can be shifted by means of the telescopic structures 12 toward each other in the same direction or apart from each other in the opposite direction to gain access to the space 17 defined between the shaft wall 4 and the rear side 16 of the rail element 1.

Figure 13:
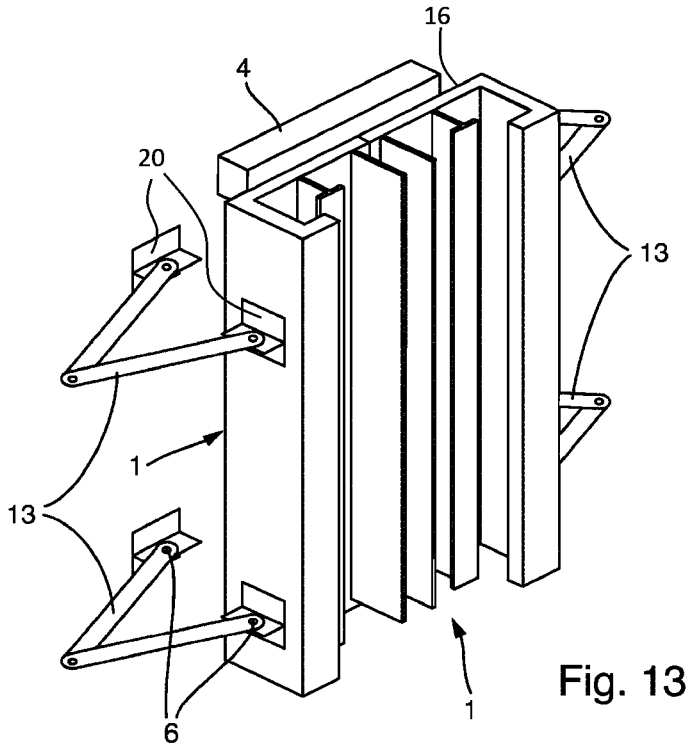
FIG. 13 is a perspective view of an example rail element having swivel arms.
Figure 14:
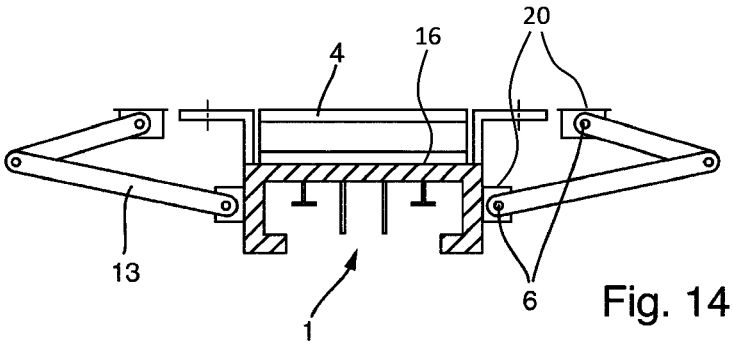
FIG. 14 is a top sectional view of the example rail element shown in FIG. 13.

FIGS. 13 and 14 (top view of the sample embodiment of FIG. 13) show another embodiment with which a rail element 1 can be mounted on a shaft wall 4 in a movable manner Here, the rail element 1 is mounted in a movable manner by fastening means 2, having swivel arms 13, on the rear shaft wall 4 from the rail element 1. The joints of the swivel arms 13 here can have hinges 3 and/or balls 9 and ball cups 10, which are attached at the wall 4 and rail element 1 at anchor points 20. The swivel arms 13 can have any given number of joints.

Instead of being fastened to the rear shaft wall 4 from the rail element, the fastening means 2 having swivel arms 13 can also be fastened, analogously to the sample embodiment of FIGS. 11 and 12, to the two shaft walls 4 toward which the right and left-side wall of the rail element 1 are facing.

By using releasable interlocks 6 at the shaft-side and/or the rail element-side ends of the fastening means 2, the rail element 1 can be swiveled even further, analogously to the sample embodiment shown in FIGS. 2 and 3.

When the rail element 1 is divided in the vertical direction Z, the individual segments 5 of the rail element 1 can be moved separately to gain access to the space 17 defined between the shaft wall 4 and the rear side 16 of the rail element 1.

Figure 15:
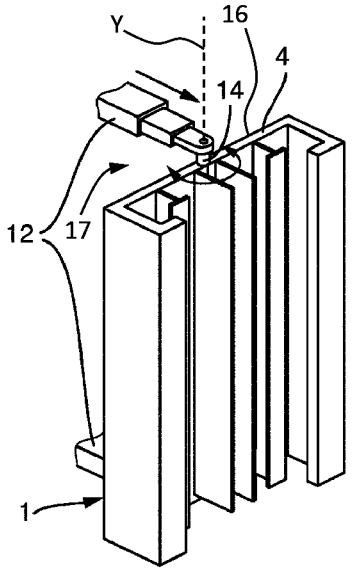
FIG. 15 is a perspective view of an example rail element with telescopic structures having anchoring points at its rail element-side ends, on which the rail element can be rotated.

In FIG. 15, the fastening means 2 that mounts a rail element 1 in a movable manner on the shaft wall 4, so as to have the rear side 16 of the rail element 1 facing the shaft wall 4, comprises telescopic structures 12 having distal ends coupled to the rail element 1 such that the rail element can be rotated on the telescopic structures 12 relative to the shaft wall 4. The telescopic structures 12 have connection elements 14 disposed at their distal ends connected to the rail element 1, in which the main direction of extension of the connection elements 14 is orthogonal to the main direction of extension of the telescopic structures 12. The connection elements or pieces 14 positioned between the distal ends of the telescopic structures 12 and the rail element 1 form the axis/axes Y of rotation about which the rail element 1 can be rotated.

Accordingly, by extending the telescopic structures 12, the rail element 1 can at first be moved into the interior of the shaft and then be rotated about the axis of rotation formed by the connection elements 14. In this way, a better access is afforded to the space 17 between the rail element 1 and the shaft wall 4, toward which the rear side 16 of the rail element 1 is facing, when the rail element 1 is in its fixed position as part of the guide rail.

Figure 16:
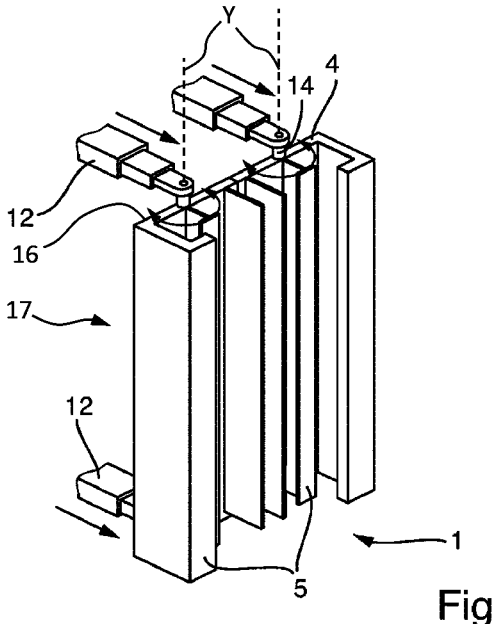
FIG. 16 is a perspective view of an example rail element divided in a vertical direction into two segments, both segments having telescopic structures which for their part have anchoring points at their rail element-side ends, on which the corresponding segment can be rotated.

FIG. 16 shows a modification of the sample embodiment shown in FIG. 15, in which the rail element 1 is divided in the vertical direction Z into segments 5. Each segment 5 is mounted in a movable manner by fastening means 2, having telescopic structures 12, to the shaft wall 4, toward which the rear sides 16 of the segments 5 are facing in their designated position as part of the guide rail. The individual segments 5 are mounted by means of connection elements 14 in a rotational manner on the telescopic structures 12. The connection elements 14 are arranged here in the orthogonal direction to the extending direction of the telescopic structures 12 between the latter and the segments 5.

With fastening means 2 designed in this manner, each segment 5 of the rail element 1 can be pushed separately into the interior of the shaft by the telescopic structures 12 and then be rotated about the axis of rotation formed by the connection elements 14, to gain access to the space 17 defined between the shaft wall 4 and the rear side 16 of the rail element 1.

In addition, the fastening means 2 in the sample embodiments of FIGS. 15 and 16 can have hinges 3 on their proximal shaft wall-side ends, which can be placed into operation individually as required by means of releasable interlocks 6. By removing the interlocks 6, the rail element 1 or the segments 5 of the rail element 1 can not only be shifted and rotated, but also swiveled by means of the hinges 3.

In the sample embodiments represented in FIGS. 15 and 16, the fastening means 2 can likewise be arranged with their proximal shaft wall-side ends on the shaft walls 4 toward which the right and left-side wall of the rail element 1 are facing (as shown in FIGS. 11 and 12).

Figure 17:
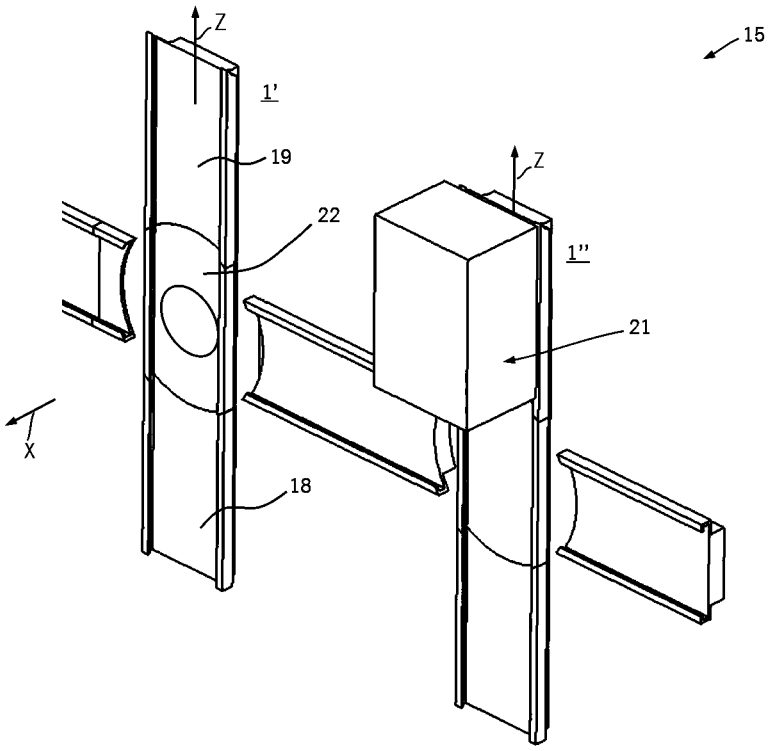
FIG. 17 is a schematic perspective view of an exemplary linear motor driven elevator system in which a guide rail of the present disclosure may be utilized.

FIG. 17 shows an exemplary schematic perspective view of an embodiment of a linear motor driven elevator system 15, in which a guide rail of the present disclosure is utilized. In the exemplary embodiment, an elevator car 21 is driven by a linear motor (not shown) along a plurality of guide rails 1', 1". The guide rails are divided into a plurality of rail elements 18, 19, 22. In the embodiment show in FIG. 17, the rail elements 18 and 19 running in the vertical direction Z are separated by a rail element 22 that can be rotated about its mounting in order to thus switch between a vertical direction and a horizontal direction in the elevator shaft, to permit an elevator car to change the direction of travel from the vertical to the horizontal direction. However, not all rail elements that are fixed to the wall and extend in one direction are separated by rotary rail elements that can change direction. In other embodiments (not shown) there may be a plurality of rail elements that are aligned end to end in a direction of travel of the elevator car, and extend for a given distance in a first direction, without an intermediary rotary rail element disposed in between. In yet other embodiments, the guide rail of the present disclosure can be practiced in elevator shafts that have no rotary rail elements, and only vertical oriented rail elements arranged end to end, in which the elevator car that travels thereon only moves in a vertical direction. In yet still other embodiments, the guide rail of the present disclosure can be practiced in elevator shafts that have no rotary rail elements, and only linearly oriented rail elements arranged end to end, in which the elevator car that travels thereon only moves along linearly along the rail element (i.e. one of either only horizontally, or only vertically, or only diagonally with respect to the horizontal or vertical directions).

REFERENCE SYMBOLS

1 Rail element
2 Fastening means
3 Hinge
4 Shaft wall
5 Segment of a rail element
6 Interlock
7 Rollers
8 Rail
9 Balls
10 Ball cup
11 Joints
12 Telescopic structure
13 Swivel arm
14 Connection element
15 Elevator system
16 Rear side
17 Space
18 Rail element
19 Rail element
20 Anchoring point
21 Elevator car
22 Rail element
Z Vertical direction
Y Axis of rotation

What is claimed is:

1. A guide rail for an elevator system, comprising:
a first rail element coupled to a shaft wall of the elevator system, and extending in a first direction;
a second rail element coupled to the shaft wall of the elevator system extending in the first direction;
a fastening means fastened to the shaft wall; and
a third movable rail element movably coupled to the shaft wall by the fastening means so as to be movable relative to the shaft wall, the movable rail element extending in the first direction and being disposed on the shaft wall adjacent to and between, but not physically coupled to, the first and second rail elements, and defining a space between a rear side of the movable rail element and the shaft wall, which space is configured to be accessible for inspection.

2. The guide rail of claim 1, wherein the movable rail element is one of a plurality of rail elements, wherein the plurality of rail elements are disposed one above another in a vertical direction on the shaft wall.

3. The guide rail of claim 1, wherein the movable rail element is vertically divided into two or more horizontally disposed adjacent rail segments that each extend in a vertical direction, wherein at least one of the segments is mounted movably relative to the shaft wall.

4. The guide rail of claim 1, wherein the movable rail element is coupled to the fastening means such that the movable rail element is configured to swivel or rotate relative to the shaft wall.

5. The guide rail of claim 1, wherein the movable rail element is coupled to the fastening means such that the movable rail element is configured to displace or travel relative to the shaft wall.

6. The guide rail of claim 1 wherein the fastening means comprises rails, wherein the rail element comprises rollers by which the rail element is mounted on the rails of the fastening means and is displaceable relative to the shaft wall.

7. The guide rail of claim 1, wherein the fastening means comprises a hinge configured to permit the movable rail element to swivel relative to the shaft wall.

8. The guide rail of claim 7, wherein the fastening means further comprises an interlock configured to selectively connect the hinge to, or release the hinge from, the movable rail element.

9. The guide rail of claim 7, wherein the fastening means further comprises an interlock configured to selectively connect the hinge to, or release the hinge from, the shaft wall.

10. The guide rail of claim 7, wherein the fastening means further comprises an interlock configured to selectively connect the hinge to, or release the hinge from, the shaft wall and/or the rail element.

11. The guide rail of claim 1 wherein the fastening means comprises a swivelable arm having joints, wherein the rail element is mounted on the swivelable arm movably relative to the shaft wall.

12. The guide rail of claim 1 wherein the fastening means has a telescopic structure.

13. The guide rail of claim 1, wherein the movable rail element is rotatable on the fastening means about an axis.

14. The guide rail of claim 1, wherein the movable rail element is configured to be anchored in a fixed position by way of an interlock disposed at an anchoring point.

15. A guide rail for an elevator system, comprising:

a first rail element coupled to a shaft wall of the elevator system, and extending in a first direction;

a second rail element coupled to the shaft wall of the elevator system extending in the first direction;

a fastening means fastened to the shaft wall; and a third movable rail element fastened to a shaft wall of the elevator system and positioned to extend in a vertical direction so as to be selectively movable relative to the shaft wall while remaining in the vertical position, the movable rail element being disposed on the shaft wall adjacent to and between, but not physically coupled to, the first and second rail elements, the movable rail element and shaft wall defining a space between a rear side of the movable rail element and the shaft wall that is accessible by moving the movable rail element relative to the shaft wall.

16. The guide rail of claim 15 wherein the rail element is divided into segments that are disposed horizontally side-by-side, wherein at least one of the segments is movable horizontally relative to the shaft wall.

17. The guide rail of claim 15, wherein the movable rail element is configured to swivel or rotate relative to the shaft wall.

18. The guide rail of claim 15 comprising rails, wherein the rail element comprises rollers by which the rail element is mounted on the rails and is displaceable relative to the shaft wall.

19. The guide rail of claim 15, further comprising:

an interlock configured to selectively lock the movable rail element in place relative to the shaft wall, and selectively release the rail element such that the rail element is movable relative to the shaft wall.

20. The guide rail of claim 15 wherein the fastening means that fastens the rail element to the shaft wall is telescopic.

* * * * *